US007426909B2

(12) United States Patent
Keane et al.

(10) Patent No.: US 7,426,909 B2
(45) Date of Patent: Sep. 23, 2008

(54) COOLING SYSTEM FOR A MACHINE

(75) Inventors: William J. Keane, Apex, NC (US); Andy J. Stough, Cary, NC (US); Robert Miller, Raleigh, NC (US); John E. Preble, Uxbridge, MA (US); Allen J. Meek, Holly Springs, NC (US); Darryl W. Smith, Angier, NC (US)

(73) Assignee: Caterpillar S.A.R.L., Geneva (CH)

( * ) Notice: Subject to any disclaimer, the term of this patent is extended or adjusted under 35 U.S.C. 154(b) by 0 days.

(21) Appl. No.: 11/642,301

(22) Filed: Dec. 20, 2006

(65) Prior Publication Data

US 2007/0144463 A1 Jun. 28, 2007

Related U.S. Application Data

(60) Provisional application No. 60/752,802, filed on Dec. 22, 2005.

(51) Int. Cl.
*F01P 3/00* (2006.01)
*F01P 7/10* (2006.01)
*B60H 1/00* (2006.01)

(52) U.S. Cl. ..... 123/41.29; 123/41.49; 165/41

(58) Field of Classification Search ..... 123/41.29, 123/41.49, 563; 165/41
See application file for complete search history.

(56) References Cited

U.S. PATENT DOCUMENTS

| | | | | |
|---|---|---|---|---|
| 4,696,361 | A | 9/1987 | Clark et al. | |
| 4,815,550 | A | 3/1989 | Mather et al. | |
| 6,092,616 | A | 7/2000 | Burris et al. | |
| 6,223,807 | B1 * | 5/2001 | Asche et al. | 165/43 |
| 6,318,347 | B1 | 11/2001 | Dicke et al. | |
| 6,546,919 | B2 | 4/2003 | Callas et al. | |
| 7,040,303 | B2 * | 5/2006 | Uzkan et al. | 123/563 |

* cited by examiner

*Primary Examiner*—Stephen K. Cronin
*Assistant Examiner*—Hyder Ali
(74) *Attorney, Agent, or Firm*—William A. Beckman

(57) ABSTRACT

A cooling system for a machine is provided. The machine has an operator compartment, a front end, and an engine cooled by a first heat exchanger and mounted within an engine compartment. The engine compartment is positioned behind the operator compartment in relation to the front end. A fan is mounted within the engine compartment and has an inlet and a first and a second outlet. A second heat exchanger is fluidically coupled to the fan and the engine and mounted within the engine compartment. A first fluid flow path extends from ambient to the inlet. A second fluid flow path extends from the first outlet to ambient and extends through the second heat exchanger. A third fluid flow path extends from the second outlet to ambient and extends through the first heat exchanger, and is thermally isolated from the second fluid flow path.

20 Claims, 3 Drawing Sheets

COOLING SYSTEM FOR A MACHINE

CLAIM FOR PRIORITY

The present application claims priority from U.S. Provisional Application Ser. No. 60/752,802, filed Dec. 22, 2005, which is fully incorporated herein.

TECHNICAL FIELD

This disclosure relates generally to a cooling system for a machine having an internal combustion engine, and more particularly, to a cooling system for a skid steer loader.

BACKGROUND

Skid steer loaders are highly maneuverable compact machines. These machines are commonly used in a variety of applications ranging from asphalt milling to earth moving, depending on the job and type of attachment being utilized. Maneuverability is enhanced by balancing the weight ratio between the front and rear axles during loaded and unloaded conditions. Balancing the weight ratio is accomplished, in part, by positioning the engine at the rear of the machine and the load or attachment being carried at the front. Accordingly, it is desirable to provide as compact a machine as possible while maintaining a favorable weight ratio balance.

The engine compartment in a typical skid steer loader is located behind and sometimes extends underneath the operator's compartment. This configuration maintains a favorable weight ratio balance while providing for a compact machine. However, this configuration also leads to a cramped engine compartment. In addition, because of this rear-mounted configuration and the fact that such machines do not typically attain particularly high ground speeds, relatively little air from travel of the machine is available to cool the engine. Cooling systems for existing designs must use a relatively large fan to draw ambient air through a radiator and hydraulic oil cooler and exhaust it out of the engine compartment. Examples of such designs are disclosed generally in U.S. Pat. No. 4,815,550 to Mather or U.S. Pat. No. 6,092,616 to Burris.

Due to increased power requirements and recent and upcoming emissions regulations, the heat load for engine cooling systems has increased. While various engine operating strategies have been developed for reducing emissions, these strategies may require more heat to be rejected by the engine for optimal performance than in traditional designs. For example, air-to-air aftercoolers or other types of heat exchangers may be used to cool incoming turbocharged air. Similarly, as operators demand more comfortable working conditions, air conditioners are used to cool the operator compartment. Both of these components add to the heat load of the cooling system.

While existing cooling systems may adequately satisfy their existing heat loads, they may not be able to handle the increased load from these additional components. Due to spatial constraints in the engine compartment, simply increasing fan size is not always viable. Some off-highway vehicles without the space constraints of a skid steer loader have used remote configurations. For example, an air conditioner condenser and electric cooling fan have been positioned in the operator cabin. Also, the air-to-air aftercooler may be mounted remotely from the main cooling package, such as that described in U.S. Pat. No. 6,546,919 to Callas. However, for a skid steer loader, a remote configuration requires additional fans, increases cost and complexity, and reduces space in an already tight engine compartment.

The present disclosure is directed to overcome one or more of the problems as set forth above.

SUMMARY OF THE INVENTION

In one aspect of the present disclosure, a cooling system for a machine is provided. The machine has an operator compartment, a front end, and an engine cooled by a first heat exchanger and mounted within an engine compartment. The engine compartment is positioned behind the operator compartment in relation to the front end. The cooling system includes a fan, a second heat exchanger, and first, second, and third fluid flow paths. The fan is mounted within the engine compartment and has an inlet and a first and a second outlet. The second heat exchanger is fluidically coupled to the fan and the engine and mounted within the engine compartment. The first fluid flow path extends from ambient to the inlet. The second fluid flow path extends from the first outlet to ambient and extends through the second heat exchanger. The third fluid flow path extends from the second outlet to ambient and extends through the first heat exchanger, and is thermally isolated from the second fluid flow path.

In another aspect of the present disclosure, a method of cooling an engine of a machine is disclosed. The machine has an operator compartment, a front end, and an engine compartment positioned behind the operator compartment in relation to the front end. The engine is fluidically coupled to a first heat exchanger and mounted within the engine compartment. The method includes the step of providing a fan mounted within the engine compartment, the fan having an inlet and a first and a second outlet. The method also includes the step of providing a second heat exchanger fluidically coupled to the fan and the engine and mounted within the engine compartment. The method also includes the step of drawing a flow of air with the fan through a first fluid flow path extending from ambient to the inlet. The method also includes the step of blowing the flow of air into a second and a third fluid flow path. The second fluid flow path extends from the first outlet to ambient and extends through the second heat exchanger, the third fluid flow path extends from the second outlet to ambient and extends through the first heat exchanger, and the second fluid flow path is thermally isolated from the third fluid flow path.

In a third aspect of the present disclosure, a cooling system for a skid steer loader is provided. The skid steer loader has an operator compartment, a front end, and an engine cooled by a radiator and mounted within an engine compartment, with the engine compartment positioned behind the operator compartment in relation to the front end. The cooling system includes a radial fan, an air-to-air aftercooler, an air conditioner condenser, and first, second, and third fluid flow paths. The radial fan is mounted within the engine compartment and has an inlet and a first and a second outlet. The air-to-air aftercooler is fluidically coupled to the radial fan and the engine and mounted within the engine compartment. The air conditioner condenser is mounted within the engine compartment and fluidically coupled to the radial fan. The first fluid flow path extends from ambient to the inlet. The second fluid flow path extends from the first outlet to ambient and extends through the air-to-air aftercooler. The third fluid flow path extends from the second outlet to ambient and extends through the radiator and air conditioner condenser, and is thermally isolated from the second fluid flow path.

DETAILED DESCRIPTION

Figure 1:
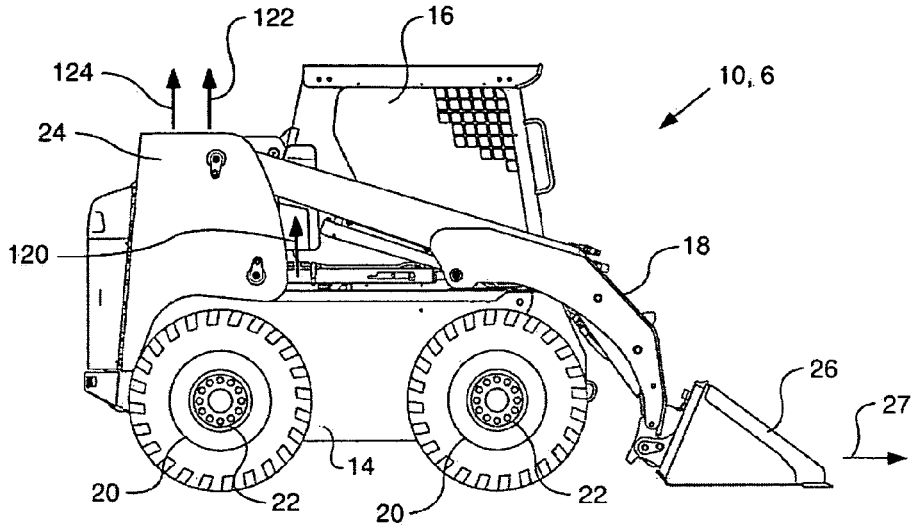
FIG. 1 is a diagrammatic illustration of a machine suitable for use with the present disclosure.

A machine 6 such as a skid steer loader 10 in accordance with the present disclosure is illustrated in FIG. 1. As shown the skid steer loader 10 includes a body portion 14, an operator compartment 16, and a lift arm assembly 18. Front and rear sets of wheels 20 are mounted to stub axles 22 that extend from each side of the body portion 14. The lift arm assembly 18 is pivotally mounted to laterally spaced side members or uprights 24 at the rear of the body portion 14 and pivotally carries a bucket or other implement 26 at the front end 27. It should be recognized that the skid steer loader 10 could be belt or track driven such as a multi-terrain skid steer loader or a compact track loader, or could have a belt entrained around front and rear wheels 20.

Figure 2:
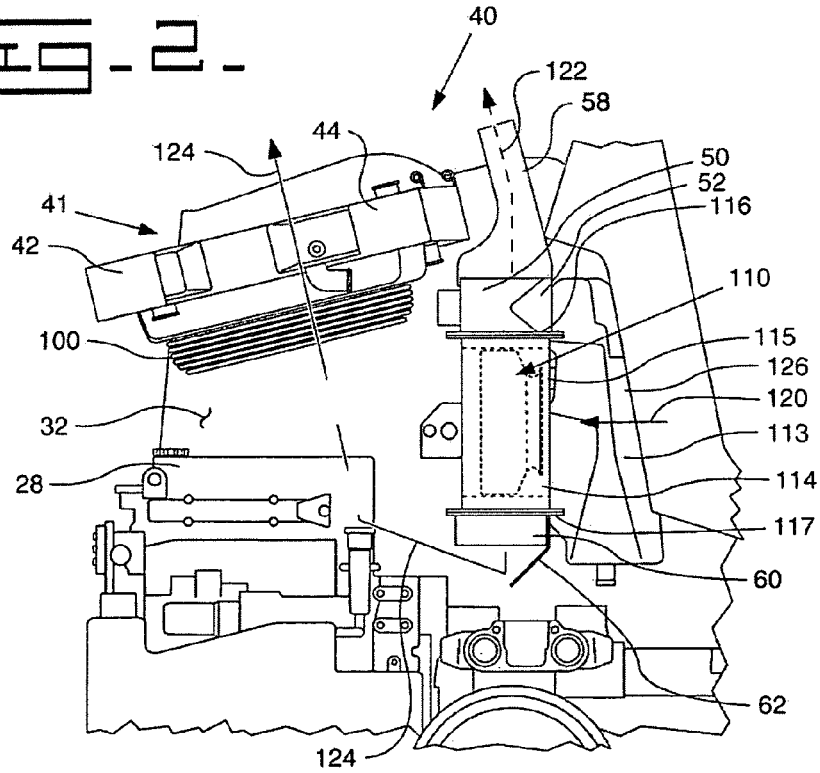
FIG. 2 is a fragmentary side view of the rear of the machine of FIG. 1 with portions cut away to illustrate the cooling system.
Figure 4:
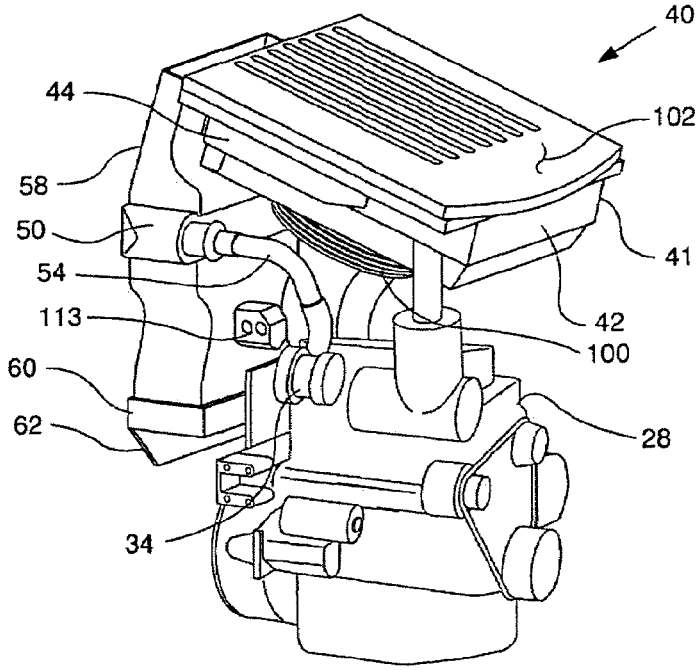
FIG. 4 is a rear perspective view of the cooling system of FIG. 2.

As best seen in FIG. 2, an engine 28 is housed in an engine compartment 32. As seen in FIG. 4, a turbocharger 34 may be used to compress the air flowing into the engine 28 for increased power. The engine 28 provides power to the skid steer loader 10 and is cooled by a cooling system 40. The cooling system 40 may include three heat-rejecting components: a primary cooling package 41 having a radiator or first heat exchanger 42 and a hydraulic oil cooler or second heat exchanger 44, an air-to-air aftercooler or third heat exchanger 50, and an air conditioner condenser or fourth heat exchanger 60.

Primary cooling package 41 may be a unitary assembly for cooling the engine 28 by liquid coolant, which is circulated through the radiator or first heat exchanger 42. The first heat exchanger 42 is connected to the engine 28 by a pair of first hoses (not shown) that permit the flow of coolant from the engine 28 through the first heat exchanger 42 and then back. Primary cooling package 41 also includes the hydraulic oil cooler or second heat exchanger 44 adjacent the first heat exchanger 42. A pair of conduits (not shown) is connected to the second heat exchanger 44 and to a conventional hydraulic system (not shown) that is in turn connected to the engine 28. The hydraulic system circulates hydraulic fluid through the pair of conduits and the second heat exchanger 44 for cooling the hydraulic fluid. An axial fan 100 blows air through first and second heat exchangers 42, 44 and out of the engine compartment 32 through grill 102. It should be noted that a primary cooling package 41 of the present disclosure incorporates components that are similar in design and/or function as described in U.S. Pat. No. 6,092,616, issued Jul. 25, 2000, and entitled Cooling System for a Skid Steer Loader. The contents of this patent are hereby incorporated by reference to avoid unnecessary duplication of the description of similar components.

Figure 3:
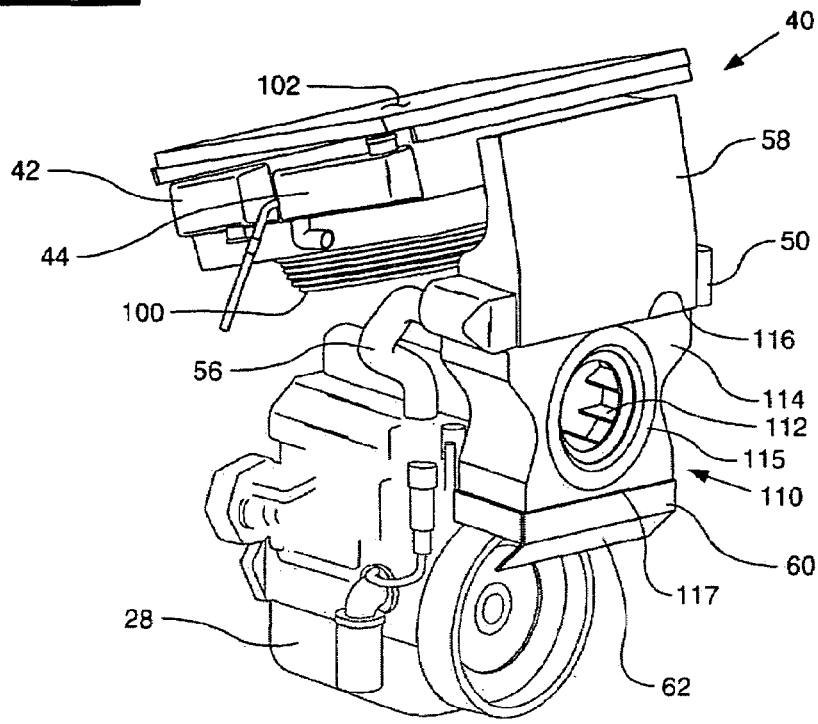
FIG. 3 is a perspective view of the cooling system of FIG. 2.

As seen in FIG. 3, a radial centrifugal or backwards curved centrifugal fan 110 is mounted in engine compartment 32. The radial fan 110 has an impeller 112 mounted within a housing 114, and is driven by a motor 113. The radial fan 110 pulls ambient air along a first fluid flow path 120 into the engine compartment 32 from the sides of the skid steer loader 10 (shown in FIG. 1) and into an inlet 115. One or more filter assemblies (not shown) may be mounted upstream of the radial fan 110 to prevent any dust, debris, or other particulates from entering the engine compartment 32 and clogging the heat exchangers 42, 44 or air-to-air-aftercooler 50. Both the air-to-air aftercooler 50 and the air conditioner condenser 60 are fluidically connected to a first and a second outlet 116, 117 in the housing 114. As shown in FIGS. 2-4, the first and second outlet 116, 117 are positioned one hundred and eighty degrees apart, although other configurations may also be used. Referring back to FIG. 2, the first fluid flow path 120 splits into a second and a third fluid flow path 122, 124 and each receives approximately one half of the total air flow from the first fluid flow path 120, although other proportions may also be used. The second and third fluid flow paths 122, 124 are fluidically isolated from each other and may also be thermally isolated from each other.

As seen in FIGS. 2-4, the air-to-air aftercooler 50 is mounted on top of the housing 114 of the radial fan 110, although other configurations may also be used. Hot compressed air from the turbocharger 34 flows into a core 52 of the air-to-air aftercooler 50 through a first conduit 54. This hot compressed air is cooled as cool ambient air in the second fluid flow path 122 and is forced through the core 52 by the radial fan 110. Ambient refers to the air in the environment existing or present on all sides of the machine 6 or skid steer loader 10, which is at atmospheric temperature, pressure, etc. As seen in FIG. 3, the cooled compressed air flows back to engine 28 through a second conduit 56. The air in the second fluid flow path 122 is directly exhausted from the engine compartment 32 to ambient through an outlet duct 58 along the second fluid flow path 122 (see FIGS. 1 and 2).

As seen in FIGS. 3-4, the air conditioner condenser 60 is mounted to the bottom of the housing 114 of the radial fan 110. The radial fan 110 blows the air in the third fluid flow path 124 over the air conditioner condenser 60 to provide cooling for operator compartment 16. An expansion valve, cold coils, and blower (not shown) may be remotely mounted in the operator compartment 16, or positioned remotely in the engine compartment 32. The air in the third fluid flow path 124 is diverted over the engine 28 and into the primary cooling package 41 by a diverter 62. FIGS. 2-4 illustrate the diverter 62 as a bent plate integrally formed with the air conditioner condenser 60, although other configurations, such as a separate duct element, may be used.

Figure 5:
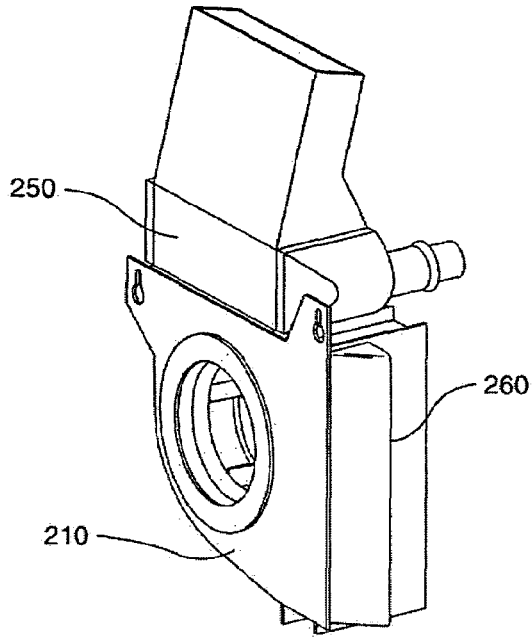
FIG. 5 is a perspective view of another exemplary arrangement of a radial fan for use with the present disclosure.
Figure 6:
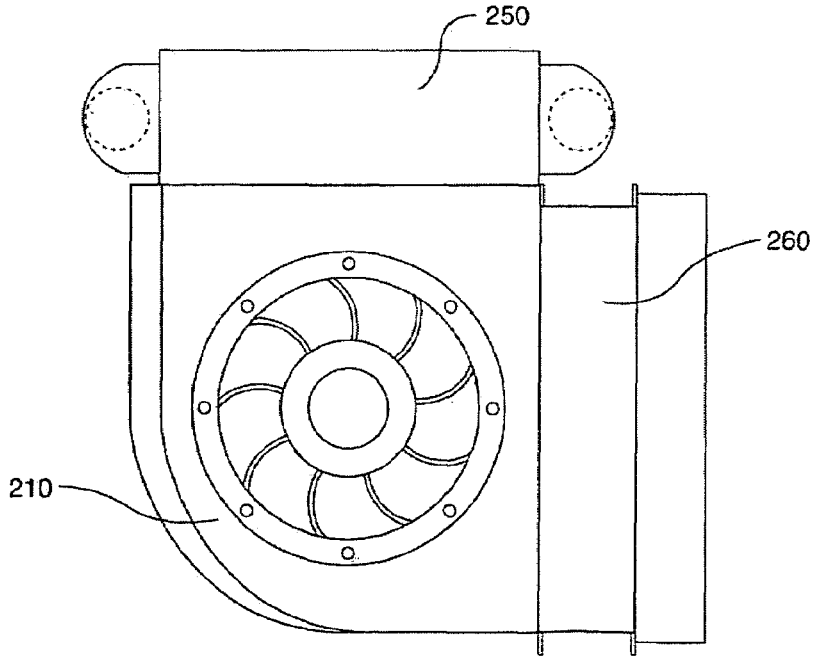
FIG. 6 is a front view of the radial fan of FIG. 5.

FIGS. 5 and 6 illustrate a second configuration for an air conditioner condenser 260. The air conditioner condenser 260 is mounted to the side of a radial fan 210, so that it is positioned ninety degrees from an air-to-air-aftercooler 250. Other aspects of air conditioner condenser 260, radial fan 210, and air-to-air aftercooler 250 are similar to the air conditioner condenser 60, radial fan 110, and air-to-air aftercooler 50 shown in FIGS. 1-4 and described above.

INDUSTRIAL APPLICABILITY

In operation, the cooling system 40 draws ambient air through the sides of the skid steer loader 10 into the first fluid flow path 120. This air in the first fluid flow path 120 may be drawn through a filter assembly (not shown) to remove dust, debris, and other particles. While a filter may cause a pressure drop, it helps prevent the fins of densely packed heat exchangers from clogging. The air in the first fluid flow path 120 is pulled into the engine compartment 32 through ductwork 126 (see FIG. 2) by the radial fan 110 and into the inlet 115. The now pressurized air from the radial fan 110 is split to flow along two thermally isolated flow paths: a second fluid flow path 122 flows through the air-to-air aftercooler 50, while the third fluid flow path 124 flows through the air conditioner condenser 60. In one exemplary embodiment, the air flows in the second and third fluid flow paths 122, 124 are approximately equal, although other proportions may be used depending on the desired cooling performance.

The air in the second fluid flow path 122 flowing over the air-to-air aftercooler 50 flows through the core 52 and cools the turbocharged intake air for the engine 28. The air in the second fluid flow path 122, heated by the rejected heat from the turbocharged engine intake air, is directly exhausted to ambient through the outlet duct 58. Because the air in the second fluid flow path 122 is directly exhausted to ambient, the primary cooling package 41 may have a lower heat rejection capacity and may be smaller.

The air in the third fluid flow path 124 flows over the air conditioner condenser 60 and cools it. The air is then diverted by a diverter 62 to flow over the engine 28, and into the primary cooling package 41. An axial fan 100 draws this air in the engine compartment 32 through the primary cooling package 41, including a radiator or first heat exchanger 42, and a hydraulic oil cooler or second heat exchanger 44, and finally out of the machine 6, 10. This air in engine compartment 32 includes air in the third fluid flow path 124 that passed through the air conditioner condenser 60 and may also include some air which bypassed the radial fan 110.

This configuration of the cooling system allows for a compact cooling package with a relatively high heat rejection capacity that can fit in the engine compartment of the skid steer loader.

While the disclosure has been described with reference to details of the illustrated embodiments, these details are not intended to limit the scope of the disclosure as defined in the appended claims. For example, the first, second, third, and fourth heat exchangers have been described with reference to particular types of heat exchangers, such as the radiator, hydraulic oil cooler, air-to-air aftercooler, and air conditioner condenser, respectively. However, it may be desired to substitute other types of heat exchangers for the ones described above. A second hydraulic oil cooler, another air-to-air aftercooler, a fuel cooler, or an engine radiator cooler may be substituted for the air conditioner condenser. Moreover, the fourth heat exchanger may be eliminated altogether. In addition, a single fan may be used for both the air-to-air aftercooler and the air conditioner condenser.

Other aspects, objects and advantages of this disclosure can be obtained from a study of the drawings, the disclosure, and the appended claims.

What is claimed is:

1. A cooling system for a machine having an operator compartment, a front end, and an engine cooled by a first heat exchanger and mounted within an engine compartment, with the engine compartment positioned behind the operator compartment in relation to the front end, comprising:

a fan mounted within the engine compartment and having an inlet and a first and a second outlet;

a second heat exchanger fluidically coupled to the fan and the engine and mounted within the engine compartment;

a first fluid flow path extending from ambient to the inlet;

a second fluid flow path extending from the first outlet to ambient and extending through the second heat exchanger; and a third fluid flow path extending from the second outlet to ambient and extending over at least a portion of the engine and through the first heat exchanger;

wherein the second fluid flow path is thermally isolated from the third fluid flow path.

2. The cooling system of claim 1, wherein the first heat exchanger is a radiator and the second heat exchanger is an air-to-air aftercooler.

3. The cooling system of claim 2, wherein the inlet is fluidically coupled to the at least one side of the machine.

4. The cooling system of claim 2 further comprising an air conditioner condenser mounted within the engine compartment and fluidically coupled to the fan, wherein the third fluid flow path extends through the air conditioner condenser.

5. The cooling system of claim 4 further comprising a diverter configured to direct the third fluid flow path over the engine.

6. The cooling system of claim 5, wherein the air-to-air aftercooler is coupled to the first outlet and the air conditioner condenser is coupled to the second outlet.

7. The cooling system of claim 3, wherein the second and the third fluid flow paths exhaust to ambient through a top of the engine compartment.

8. The cooling system of claim 1, wherein the machine is a skid steer loader.

9. The cooling system of claim 1 further comprising:

a second fan mounted within the engine compartment upstream of the first heat exchanger and downstream of the engine along the third fluid flow path;

wherein the third fluid flow path extends through the second fan.

10. A method of cooling an engine of a machine having an operator compartment, a front end, and an engine compartment positioned behind the operator compartment in relation to the front end, with the engine fluidically coupled to a first heat exchanger and mounted within the engine compartment, comprising the steps of:

providing a fan mounted within the engine compartment, the fan having an inlet and a first and a second outlet;

providing a second heat exchanger fluidically coupled to the fan and the engine and mounted within the engine compartment;

drawing a flow of air with the fan through a first fluid flow path extending from ambient to the inlet; and blowing the flow of air into a second and a third fluid flow path, wherein the second fluid flow path extends from the first outlet to ambient and extends through the second heat exchanger, the third fluid flow path extends from the second outlet to ambient and extends over at least a portion of the engine and through the first heat exchanger, and the second fluid flow path is thermally isolated from the third fluid flow path.

11. The method of claim 10, wherein the first heat exchanger is a radiator and the second heat exchanger is an air-to-air aftercooler.

12. The method of cooling of claim 11, including:

providing an air conditioner condenser mounted within the engine compartment and fluidically coupled to the fan, wherein the third fluid flow path extends through the air conditioner condenser.

13. The method of cooling of claim 12, including the step of:

diverting the third fluid flow path to flow over at least a portion of the engine.

14. The method of cooling claim 12, including the steps of:

coupling the second heat exchanger to the first outlet; and coupling the air conditioner condenser to the second outlet.

15. The method of claim 11, wherein the machine is a skid steer loader.

16. The method of claim 10, wherein the step of drawing a flow of air from ambient to the inlet is drawn through at least one side of the machine; wherein the step of blowing a flow of air into a third fluid flow path exhausts to ambient through a top of the engine compartment; and including:

providing a second fan mounted within the engine compartment, wherein the third fluid flow path extends through the second fan.

17. A cooling system for a skid steer loader having an operator compartment, a front end, and an engine cooled by a radiator and mounted within a skid steer loader engine compartment, with the engine compartment positioned behind the operator compartment in relation to the front end, comprising:

a fan mounted within the skid steer loader engine compartment and having an inlet and a first and a second outlet;

an air-to-air aftercooler fluidically coupled to the radial fan and the engine and mounted within the skid steer loader engine compartment;

an air conditioner condenser mounted within the skid steer loader engine compartment and fluidically coupled to the fan;

a first fluid flow path extending from ambient to the inlet;

a second fluid flow path extending from the first outlet to ambient and extending through the air-to-air aftercooler; and a third fluid flow path extending from the second outlet to ambient and extending through the air conditioner condenser and the radiator;

wherein the second fluid flow path is thermally isolated from the third fluid flow path.

18. The cooling system of claim 17 further comprising a diverter configured to direct the third fluid flow path over at least a portion of the engine.

19. The cooling system of claim 17, wherein the air-to-air aftercooler is coupled to the first outlet and the air conditioner condenser is coupled to the second outlet.

20. The cooling system of claim 17 further comprising:

a second fan mounted within the skid steer loader engine compartment upstream of the radiator and downstream of the engine along the third fluid flow path;

wherein the third fluid flow path extends through the second fan, the inlet is fluidically coupled to the at least one side of the skid steer loader, and the second and the third fluid flow paths exhaust to ambient through a top of the skid steer loader engine compartment.

* * * * *